US008316987B2

(12) United States Patent
Ishida et al.

(10) Patent No.: US 8,316,987 B2
(45) Date of Patent: Nov. 27, 2012

(54) MUFFLING STRUCTURE OF VENT PIPE AND MUFFLING STRUCTURE OF CASE

(75) Inventors: Kosaku Ishida, Kanagawa (JP); Yoshitaka Watanabe, Shiga (JP); Kazutaka Hara, Shiga (JP)

(73) Assignee: Tokyo Roki Co., Ltd., Kanagawa (JP)

( * ) Notice: Subject to any disclaimer, the term of this patent is extended or adjusted under 35 U.S.C. 154(b) by 0 days.

(21) Appl. No.: 12/918,550

(22) PCT Filed: Feb. 23, 2009

(86) PCT No.: PCT/JP2009/053198

§ 371 (c)(1),
(2), (4) Date: Sep. 30, 2010

(87) PCT Pub. No.: WO2009/110344

PCT Pub. Date: Sep. 11, 2009

(65) Prior Publication Data

US 2011/0011670 A1 Jan. 20, 2011

(30) Foreign Application Priority Data

Mar. 4, 2008 (WO) ..... PCT/JP2008/053815

(51) Int. Cl.
*F01N 1/04* (2006.01)
*F01N 1/24* (2006.01)

(52) U.S. Cl. ..... 181/247; 181/229; 181/250

(58) Field of Classification Search ..... 181/247, 181/248, 249, 250, 252, 229, 256
See application file for complete search history.

(56) References Cited

U.S. PATENT DOCUMENTS

| | | | | |
|---|---|---|---|---|
| 5,266,755 | A * | 11/1993 | Chien | 181/252 |
| 6,440,200 | B1 | 8/2002 | Sakakibara et al. | |
| 6,817,345 | B2 * | 11/2004 | Lawrence | 123/518 |
| 7,743,880 | B2 | 6/2010 | Matsumura et al. | |
| 2002/0029693 | A1 | 3/2002 | Sakakibara et al. | |
| 2004/0262077 | A1 * | 12/2004 | Huff et al. | 181/250 |
| 2007/0227513 | A1 | 10/2007 | Fujishiro et al. | |

FOREIGN PATENT DOCUMENTS

| | | | |
|---|---|---|---|
| CN | 2537828 | | 2/2003 |
| CN | 101151417 | A | 3/2008 |
| DE | 000010058479 | | 5/2002 |
| EP | 509782 | A1 | 10/1992 |
| JP | 58-072669 | | 4/1983 |
| JP | 61-101018 | | 6/1986 |
| JP | 62-101018 | | 6/1987 |
| JP | 63-18180 | A | 1/1988 |
| JP | 1-7066 | A | 1/1989 |

(Continued)

*Primary Examiner* — Jeremy Luks

(74) *Attorney, Agent, or Firm* — Harness, Dickey & Pierce, PLC

(57) ABSTRACT

The present invention aims to provide a muffling structure of a vent pipe and a muffling structure of a case, which is capable of muffling in a wide frequency range and preventing vent resistance in the air pipe or the case from deterioration. Vent holes (11*a*) are formed in the peripheral wall of the vent pipe (11), a cover (12) is so provided on the peripheral wall of the vent pipe (11) as to cover the vent holes (!1*a*), and a bag-like body (13) in which activated charcoal (14) is contained is disposed in the space formed by the peripheral wall of the vent pipe (11) and the inner wall of the cover (12).

4 Claims, 14 Drawing Sheets sec A-A

FOREIGN PATENT DOCUMENTS

| | | | |
|---|---|---|---|
| JP | 2-20776 | | 2/1990 |
| JP | 9-112370 | A | 4/1997 |
| JP | 4-318269 | A | 1/2002 |
| JP | 2002-4956 | A | 1/2002 |
| JP | 2003-035225 | | 2/2003 |
| JP | 2003-35225 | A | 2/2003 |
| JP | 2006-352647 | A | 12/2006 |
| JP | 2007-231881 | A | 9/2007 |
| JP | 2007-231882 | A | 9/2007 |
| RU | 2069773 | | 11/1996 |
| WO | WO 2006/106854 | A1 | 10/2006 |

* cited by examiner sec A-A

MUFFLING STRUCTURE OF VENT PIPE AND MUFFLING STRUCTURE OF CASE

TECHNICAL FIELD

The present invention relates to a muffling structure of a vent pipe and a muffling structure of a case.

BACKGROUND ART

Noise tends to be produced in a vent pipe (such as a duct, an intake pipe, and an exhaust pipe) and a case (such as a case for an air cleaner) provided with a vent pipe. Among them, loud noise tends to be produced in a vent pipe and a case provided in an internal combustion engine, a fuel cell, a blower, and any other intake system. A muffling structure is therefore typically provided in a vent pipe and a case provided with a vent pipe to eliminate the noise. For example, the following Patent Documents 1 and 2 have been known as conventional techniques on a muffling structure of a vent pipe.

Patent Document 1 (Japanese Patent Laid-Open No. 2007-231881) discloses a muffling structure in which a porous portion is provided in a vent pipe. In the muffling structure, the porous portion can function to muffle sound in a wide frequency range.

On the other hand, Patent Document 2 (Japanese Patent Laid-Open No. 2007-231882) discloses a muffling structure using a Helmholtz resonator. In the muffling structure, the Helmholtz resonator can effectively function to muffle sound in a specific frequency range. Further, disposed external to a vent pipe in the muffling structure, the Helmholtz resonator unlikely hinders ventilation, which allows preventing vent resistance in the vent pipe from deterioration.

DISCLOSURE OF THE INVENTION

Problems to be Solved by the Invention

In the conventional technique disclosed in Patent Document 1, however, the vent resistance in the vent pipe deteriorates because the porous portion provided in the vent pipe hinders ventilation. On the other hand, the Helmholtz resonator can only function to muffle sound in a specific frequency range. Therefore, the conventional technique disclosed in Patent Document 2 cannot muffle sound in a wide frequency range.

The present invention has been made in view of the problems of the conventional techniques. An object of the present invention is to provide a muffling structure of a vent pipe and a muffling structure of a case, which is capable of muffling sound in a wide frequency range and preventing vent resistance in the vent pipe or the case from deterioration.

Means for Solving the Problems

To solve the problems described above, the present invention provides the following means.

A first aspect of the present invention is a muffling structure of a vent pipe, characterized in that the vent pipe is a primary duct, and that the muffling structure includes vent holes formed in peripheral wall of the primary duct, a cover so provided outside the peripheral wall as to cover the vent holes, activated charcoal contained in the cover, and a ventilative member interposed between the activated charcoal and the peripheral wall.

The first aspect of the present invention is also characterized in that the vent holes are provided in the peripheral wall except the bottom thereof.

A second aspect of the present invention is a muffling structure of a case provided with a vent pipe for introduction purposes and a vent pipe for discharge purposes, characterized in that the muffling structure includes an inner pipe that is disposed in the case and communicates with the introduction vent pipe or the discharge vent pipe, vent holes formed in a peripheral wall of the inner pipe, a cover so provided outside the peripheral wall as to cover the vent holes, activated charcoal contained in the cover, and a ventilative member interposed between the activated charcoal and the peripheral wall.

The second aspect of the present invention is also characterized in that the vent holes are provided in the peripheral wall except the bottom thereof.

CROSS REFERENCE TO RELATED DOCUMENTS

The present application claims the priority based on International Application (PCT/JP2008/53815) filed on Mar. 4, 2008, and the contents of which is hereby incorporated in the present application.

Advantage of the Invention

The present invention is capable of muffling sound in a wide frequency range and preventing vent resistance in a vent pipe or a case from deterioration.

DESCRIPTION OF SYMBOLS

Figure 1:
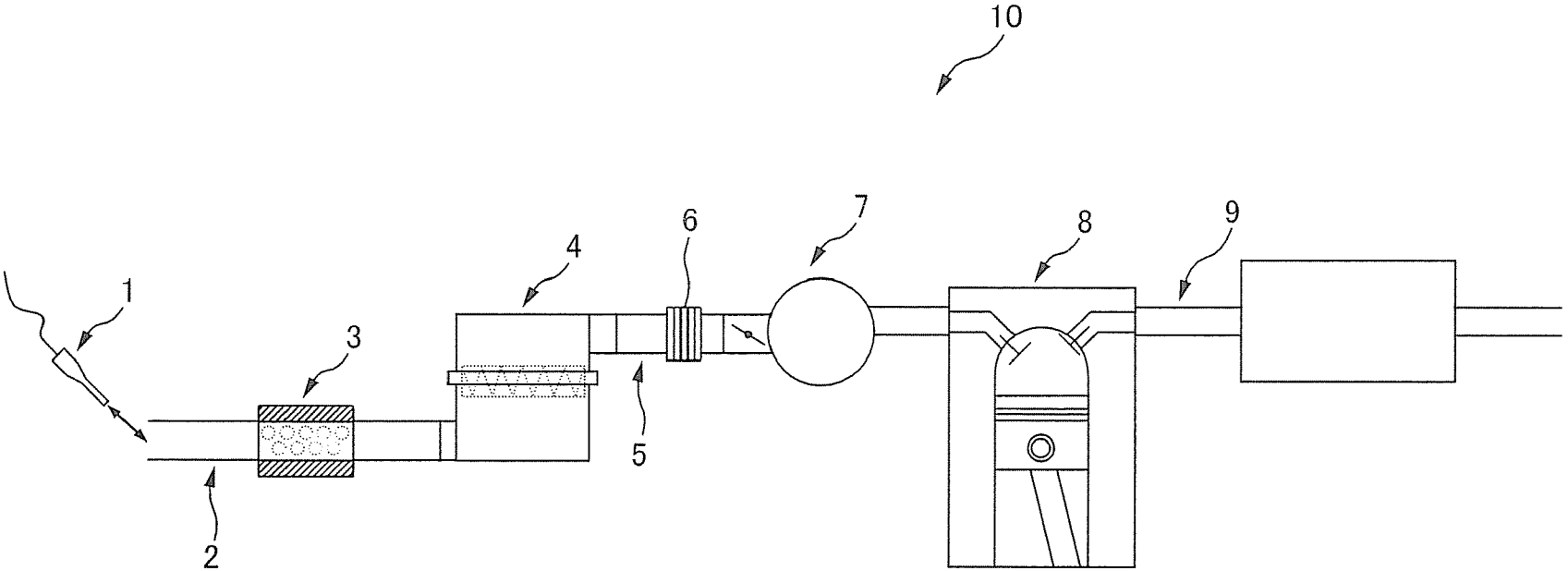
FIG. 1 shows a test apparatus used in a test for confirming the present invention.

310, 320, 330, 340, 350, 410, 500, 510, 520, 530, 540 silencer
11, 21, 31, 41, 51, 401, 503, 504 vent pipe

11*a*, 21*a*, 31*a*, 41*a*, 51*a*, 411*a*, 501*c*, 601*a* vent hole
12, 22, 32, 42, 52, 412 cover
13, 23, 33, 43, 53, 413 bag-like body
14, 24, 34, 44, 54, 414, 512 activated charcoal
400 case
411 inner pipe
511 ventilative member

BEST MODE FOR CARRYING OUT THE INVENTION

Test for Confirming Present Invention

Figure 2:
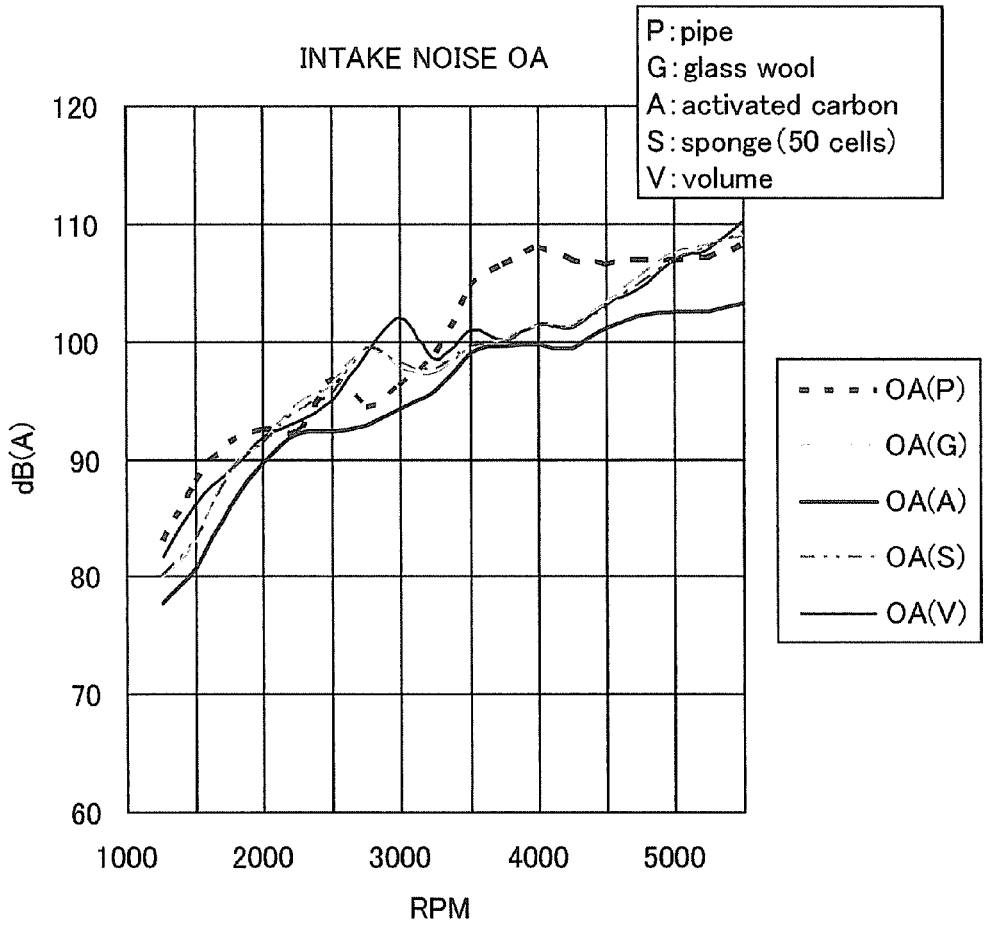
FIG. 2 shows graphs illustrating the sound pressure (dB) of noise measured with a noise meter versus the speed (RPM) of a four-cylinder gasoline engine.
Figure 3A:
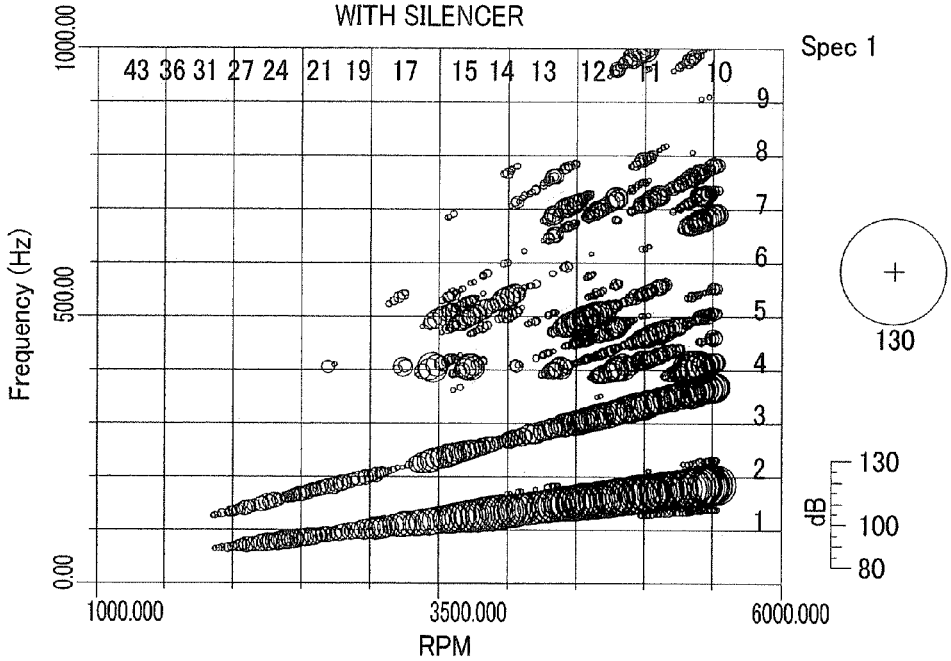
FIGS. 3A and 3B show graphs illustrating the frequency (Hz) of noise measured with the noise meter versus the speed (RPM) of the four-cylinder gasoline engine.
Figure 3B:
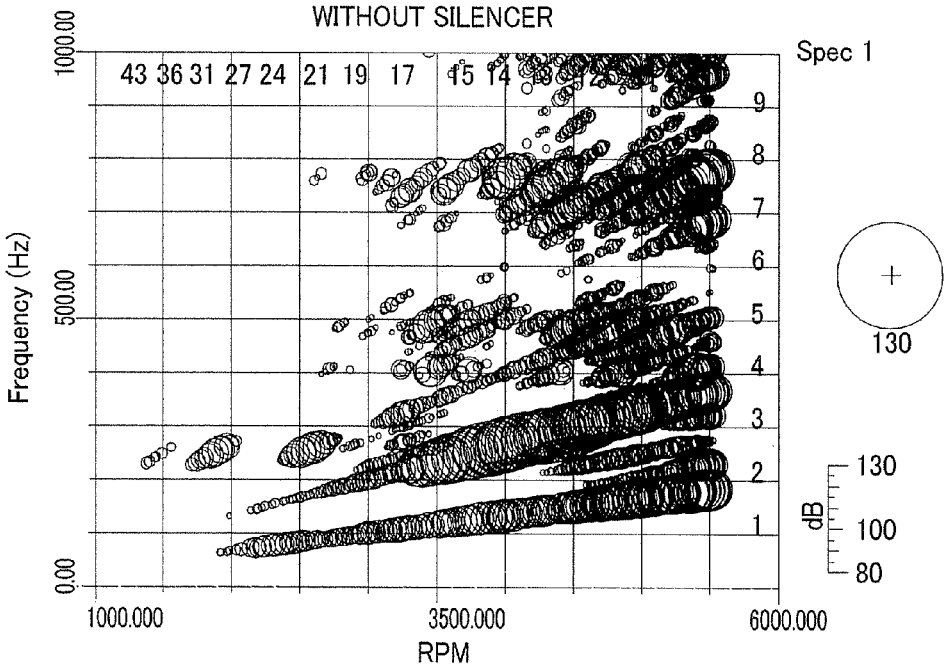

The present inventors have focused on the fact that activated charcoal has a muffling effect and attained the present invention by using the muffling effect of activated charcoal. To confirm an advantageous effect of the present invention, the present inventors have used a test apparatus 10 shown in FIG. 1 to carry out an intake noise test based on a four-cylinder gasoline engine. FIGS. 2 and 3 show results of the intake noise test.

The test apparatus 10 shown in FIG. 1 includes a noise meter 1, a primary duct 2, a silencer 3, an air cleaner 4, a secondary duct 5, a rubber hose with bellows 6, an intake manifold 7, a four-cylinder gasoline engine 8, and an exhaust pipe 9.

The noise meter 1 is disposed in a position spaced apart from an upstream end of the primary duct 2 by 100 mm and inclined to the upstream end by 45 degrees. The primary duct 2 is 56 mm in inner diameter and 620 mm in length. The silencer 3 is attached to a substantially central portion of the primary duct 2. One hundred vent holes (10 mm in diameter) are formed in the peripheral wall of the primary duct 2. The silencer 3 has a muffling portion having a volume of 0.5 liter. A bag-like body formed of a ventilative sheet is disposed in the silencer 3. The bag-like body contains 300 cc of particulate activated charcoal (approximately 20 angstroms in average pore diameter). The ventilative sheet is made of a nonwoven fabric and specifically approximately 3 mm in thickness and approximately 80 to 100 μm in pore diameter (average pore size). The volume of the air cleaner 4 is 5 liters. The rubber hose with bellows 6 is 70 mm in inner diameter and 350 mm in length. The volume of the four-cylinder gasoline engine 8 is 2.3 liters.

FIG. 2 shows graphs illustrating the sound pressure (dB) of noise measured with the noise meter 1 versus the speed (RPM) of the four-cylinder gasoline engine 8. The meanings of the symbols shown in FIG. 2 ("A", "P", "G", "S", and "V") are as follows: "A" represents a test result obtained when the silencer 3 is attached to the primary duct 2. "P" represents a test result obtained when no silencer is attached to the primary duct 2 (Comparative Example 1). "G" represents a test result obtained when a silencer filled with glass wool is attached to the primary duct 2 (Comparative Example 2). "S" represents a test result obtained when a silencer filled with sponge (50 cells) is attached to the primary duct 2 (Comparative Example 3). "V" represents a test result obtained when an empty silencer is attached to the primary duct 2 (Comparative Example 4).

FIG. 3 shows graphs illustrating the frequency (Hz) of noise measured with the noise meter 1 versus the speed (RPM) of the four-cylinder gasoline engine 8. FIG. 3(*a*) shows a test result obtained when the silencer 3 is attached to the primary duct 2 (with a silencer). FIG. 3(*b*) shows a test result obtained when no silencer is attached to the primary duct 2 (without a silencer).

First, when the silencer 3 is attached to the primary duct 2, the sound pressure (dB) of noise is lowered over all the frequency range, as compared with those in Comparative Examples 1 to 4, as shown in FIG. 2.

When the silencer 3 is attached to the primary duct 2, noise is significantly lowered over a wide frequency range (Hz), as compared with the case where no silencer is attached to the primary duct 2, as shown in FIG. 3. According to the present invention, it can therefore be said that sound can be muffled in a wide frequency range. Further, in the present invention, no obstacle that may cause vent resistance is provided in a vent pipe (primary duct 2 in FIG. 1). The present invention can therefore prevent vent resistance from deterioration.

Muffling Structure of Vent Pipe

A muffling structure of a vent pipe of the present invention will next be described with reference to FIGS. 4 to 8. FIGS. 4 to 8 show a key portion of the present invention in Examples 1 to 5.

Example 1

Configuration of Silencer 310

Figure 4A:
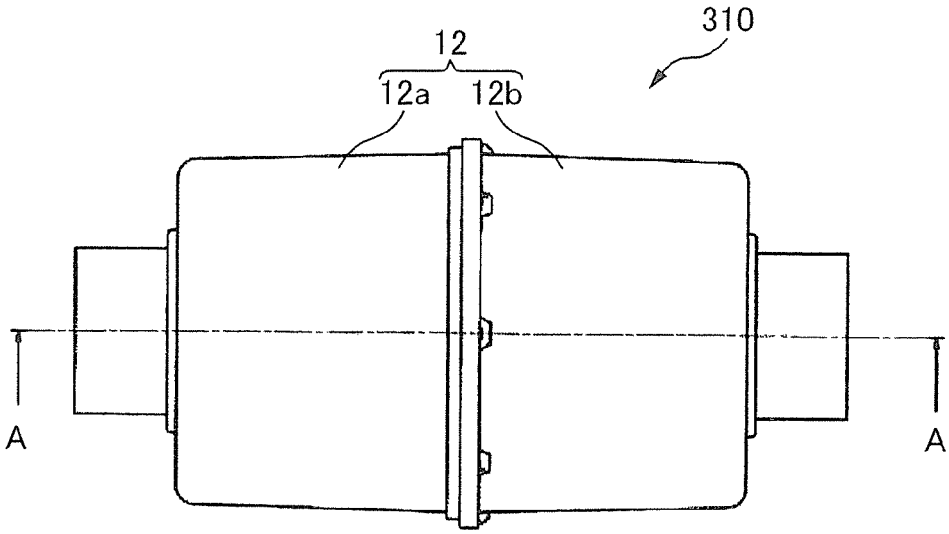
FIGS. 4A and 4B show an exemplary muffling structure (silencer 310 in Example 1) of a vent pipe.
Figure 4B:
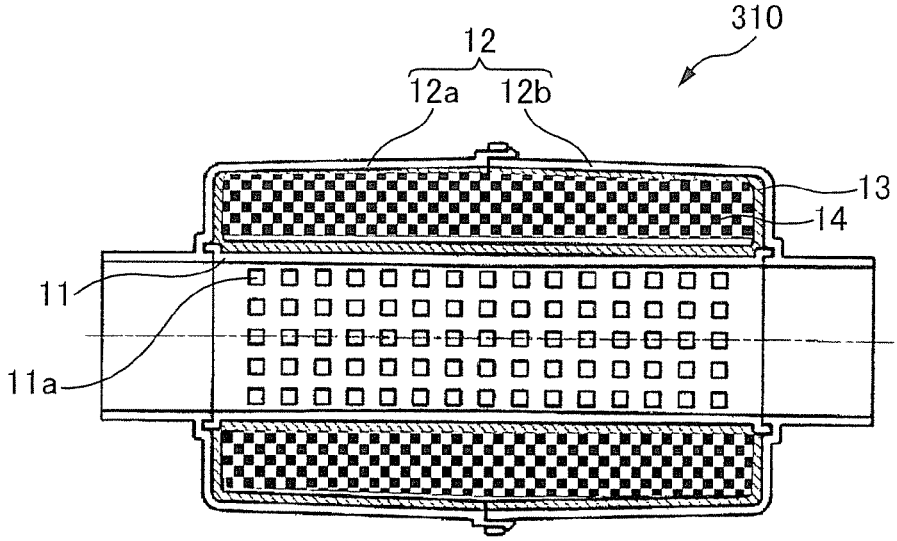

FIG. 4 shows a silencer 310 in Example 1 of the present invention. FIG. 4(*a*) is a side view of the silencer 310. FIG. 4(*b*) is a cross-sectional view taken along the line A-A in FIG. 4(*a*).

The silencer 310 shown in FIG. 4 includes a vent pipe 11, a cover 12, a bag-like body 13, and activated charcoal 14. Vent holes 11*a* are formed in the peripheral wall of the vent pipe 11. The cover 12 is formed of a cover 12*a* and a cover 12*b* made of a non-ventilative material. On the other hand, the bag-like body 13 is formed of a ventilative member (such as a ventilative sheet) made, for example, of nonwoven fabric, paper, sponge or felt. The activated charcoal 14 is, for example, particulate activated charcoal, honeycomb activated charcoal, fibrous activated charcoal, or activated charcoal-containing paper. The vent pipe 11 is attached to the cover 12 so that the vent pipe 11 fits into the cover 12. The bag-like body 13 is disposed in the space created by the peripheral wall of the vent pipe 11 and the inner wall of the cover 12. The bag-like body 13 contains the activated charcoal 14.

Example 2

Configuration of Silencer 320

Figure 5A:
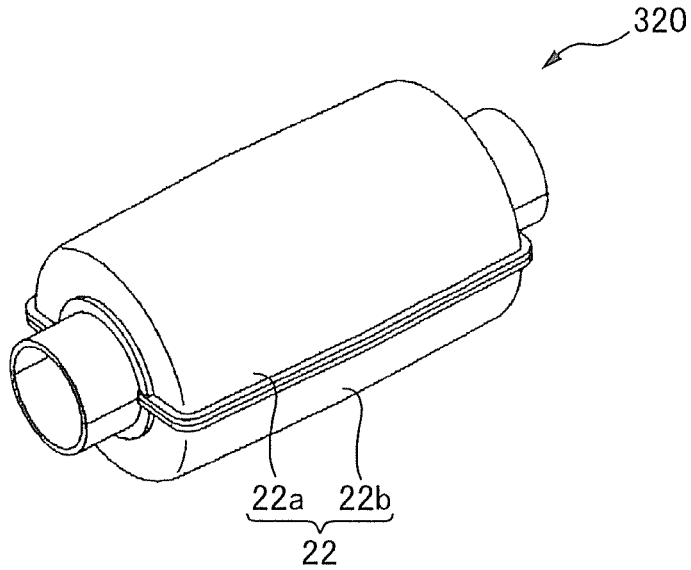
FIGS. 5A and 5B show another exemplary muffling structure (silencer 320 in Example 2) of a vent pipe.
Figure 5B:
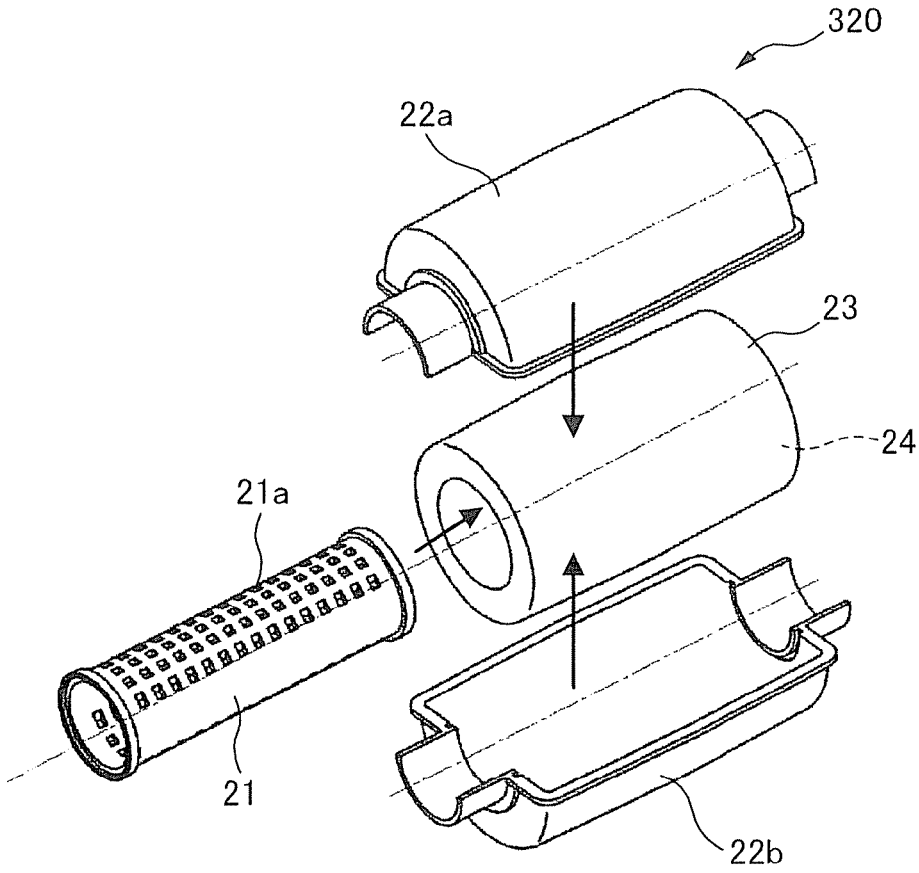

FIG. 5 shows a silencer 320 in Example 2 of the present invention. FIG. 5(*a*) is a perspective view of the silencer 320. FIG. 5(*b*) is an exploded perspective view of the silencer 320.

The silencer 320 shown in FIG. 5 has a configuration similar to that of the silencer 310 shown in FIG. 4 and specifically includes a vent pipe 21, a cover 22, a bag-like body 23, and activated charcoal 24. Vent holes 21*a* are formed in the peripheral wall of the vent pipe 21. The cover 22 is formed of a cover 22*a* and a cover 22*b*.

Example 3

Configuration of Silencer 330

Figure 6A:
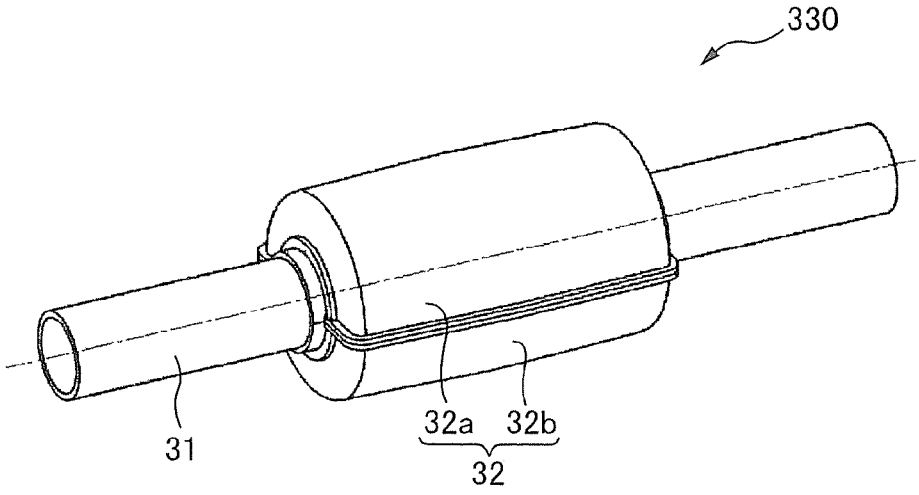
FIGS. 6A and 6B show another exemplary muffling structure (silencer 330 in Example 3) of a vent pipe.
Figure 6B:
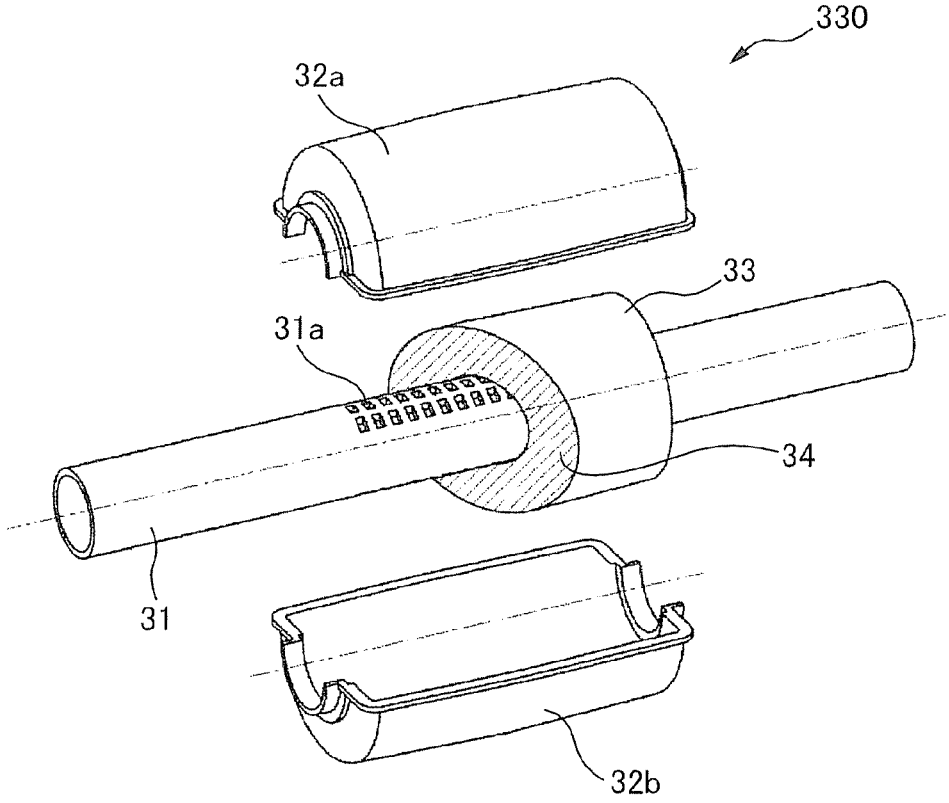

FIG. 6 shows a silencer 330 in Example 3 of the present invention. FIG. 6(*a*) is a perspective view of the silencer 330. FIG. 6(*b*) is an exploded perspective view of the silencer 330.

The silencer 330 shown in FIG. 6 has a configuration similar to that of the silencer 320 shown in FIG. 5 and specifically includes a vent pipe 31, a cover 32, a bag-like body 33, and activated charcoal 34. The cover 32 is formed of a cover 32*a* and a cover 32*b*. The vent pipe 31 is attached to the cover 32 in such a way that the vent pipe 31 is inserted into the cover 32.

Example 4

Configuration of Silencer 340

Figure 7A:
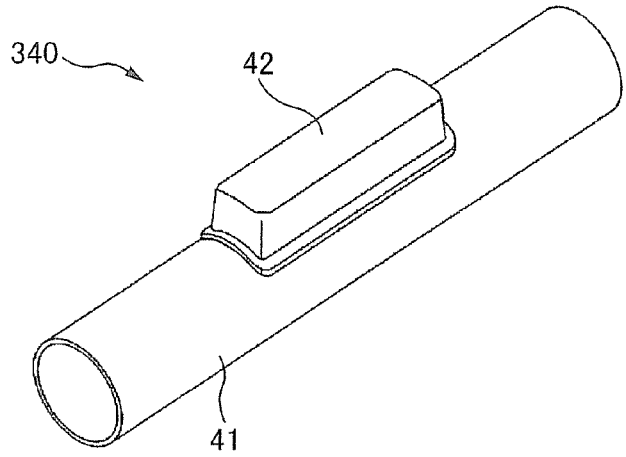
FIGS. 7A to 7C show another exemplary muffling structure (silencer 340 in Example 4) of a vent pipe.
Figure 7B:
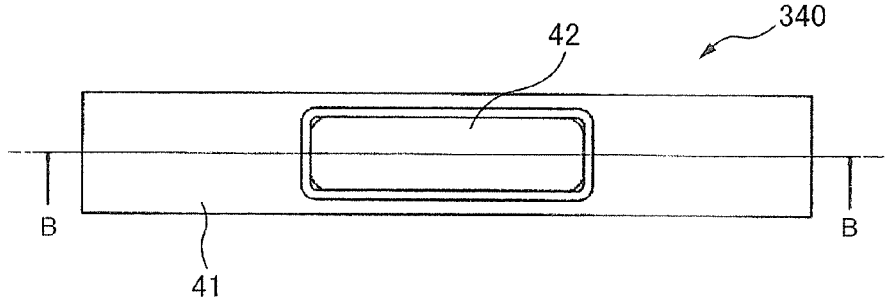
Figure 7C:
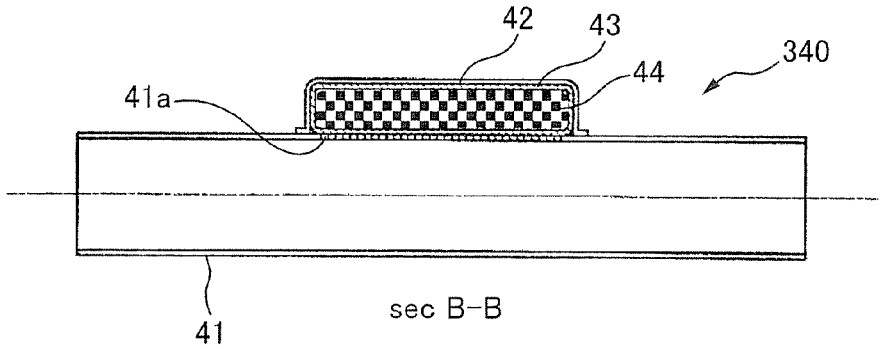

FIG. 7 shows a silencer 340 in Example 4 of the present invention. FIG. 7(*a*) is a perspective view of the silencer 340. FIG. 7(*b*) shows the silencer 340 shown in FIG. 7(*a*) viewed from the above. FIG. 7(*c*) is a cross-sectional view of the silencer 340 taken along the line B-B shown in FIG. 7(*b*).

In the silencer 340 shown in FIG. 7, vent holes 41*a* are formed in part of the peripheral wall of a vent pipe 41, and a cover 42 is so provided as to cover the vent holes 41*a*. A bag-like body 43 is disposed in the space created by the peripheral wall of the vent pipe 41 and the inner wall of the cover 42. The bag-like body 43 contains activated charcoal 44.

Example 5

Configuration of Silencer 350

Figure 8A:
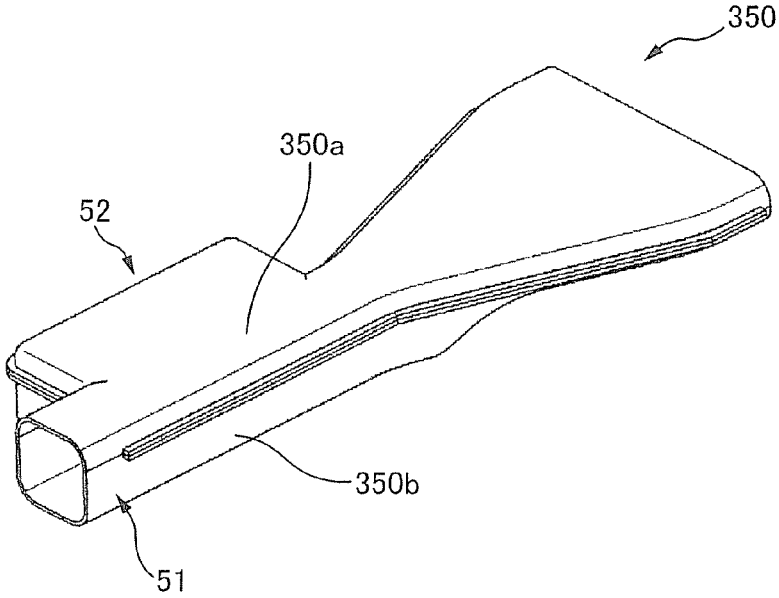
FIGS. 8A and 8B show another exemplary muffling structure (silencer 350 in Example 5) of a vent pipe.
Figure 8B:
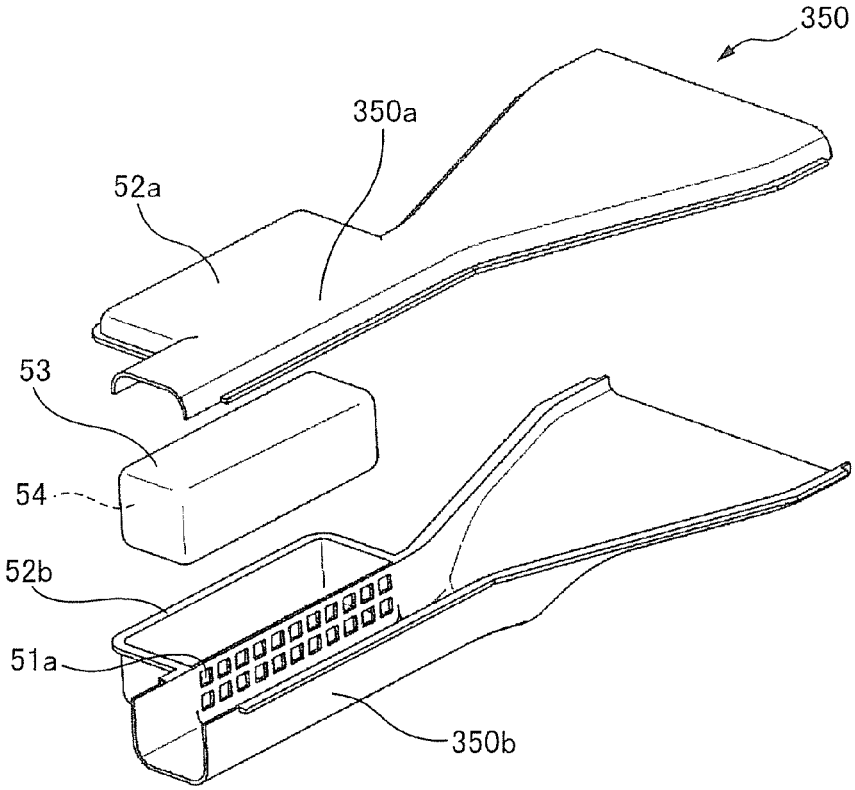

FIG. 8 shows a silencer 350 in Example 5 of the present invention. FIG. 8(*a*) is a perspective view of the silencer 350. FIG. 8(*b*) is an exploded perspective view of the silencer 350.

The silencer 350 shown in FIG. 8 includes a casing 350*a*, a casing 350*b*, a bag-like body 53, and activated charcoal 54. A lid 52*a* is integrated with the casing 350*a*. Vent holes 51*a* are formed in the peripheral wall of the casing 350*b*, and an accommodating portion 52*b* is integrated with the casing 350*b* in such a way that the accommodating portion 52*b* covers the vent holes 51*a*. The bag-like body 53 containing the activated charcoal 54 is disposed in the accommodating portion 52*b*, and the casing 350*a* is combined with the casing 350*b*. The silencer 350 in which a vent pipe 51 is integrated with a cover 52 is thus produced.

<Function of the Silencers>

In a vent pipe provided with any of the silencers of Examples 1 to 5, the activated charcoal can function to muffle sound in a wide frequency range. Further, in any of the cases, no obstacle that may cause vent resistance is provided in the vent pipe. Each of the silencers can therefore prevent vent resistance from deterioration.

<Muffling Structure of Case>

Figure 9A:
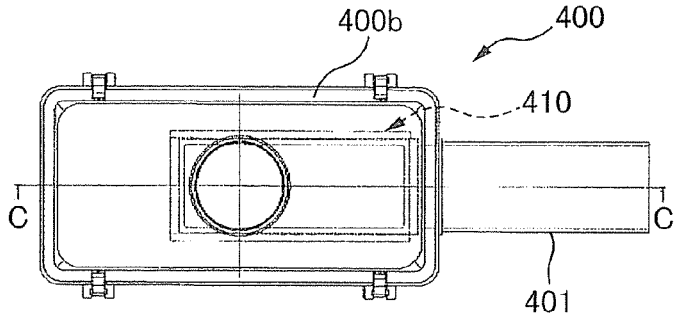
FIGS. 9A to 9C show an exemplary muffling structure of a case.
Figure 9C:
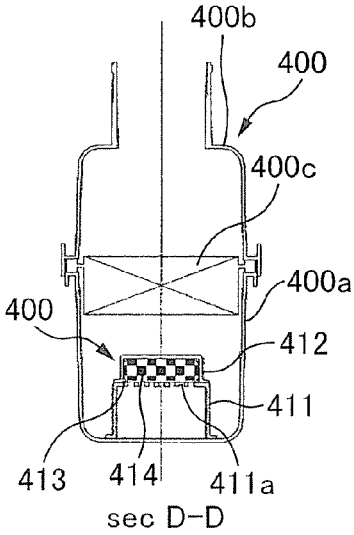
Figure 9B:
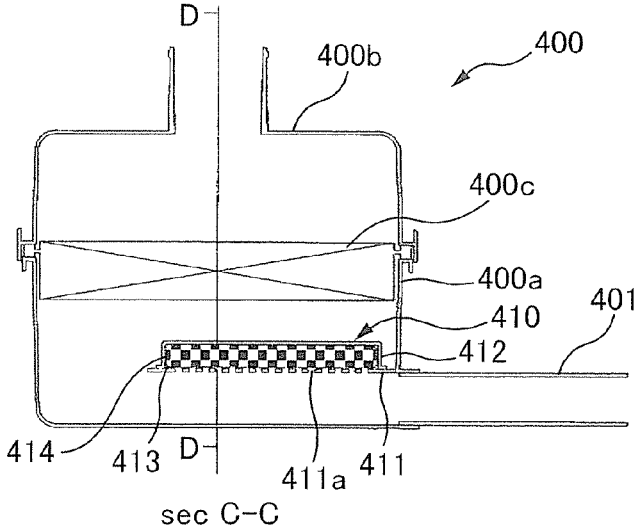

A description of a muffling structure of a case of the present invention will next be made with reference to FIG. 9. FIG. 9 shows an exemplary muffling structure of a case. FIG. 9(*a*) shows a case 400 viewed from the above. FIG. 9(*b*) is a cross-sectional view of the case 400 taken along the line C-C shown in FIG. 9(*a*). FIG. 9(*c*) is a cross-sectional view of the case 400 taken along the line D-D shown in FIG. 9(*b*).

The case 400 shown in FIG. 9 is an air cleaner for an internal combustion engine. The case 400 includes a casing 400*a*, a casing 400*b*, a filter element 400*c*, and a silencer 410. The casing 400*a* is provided with a vent pipe 401 (specifically, a primary duct) for introducing fresh air. On the other hand, the casing 400*b* is provided with a vent pipe for discharging the internal air (not shown).

The silencer 410 is attached to an inner pipe 411, which is provided in the case 400 in such a manner as to communicate with the vent pipe 401. The silencer 410 includes a cover 412, a bag-like body 413, and activated charcoal 414. Vent holes 411*a* are formed in the peripheral wall of the inner pipe 411, and the cover 412 is so provided as to cover the vent holes 411*a*. The bag-like body 413 containing the activated charcoal 414 is disposed in the space created by the peripheral wall of the inner pipe 411 and the inner wall of the cover 412.

In the case 400 provided with the silencer 410, the activated charcoal 414 can function to muffle sound in a wide frequency range. Further, although the silencer 410 is attached to the inner pipe 411, no obstacle that may cause vent resistance is provided in the inner pipe 411. The silencer 410 can therefore also prevent vent resistance from deterioration.

Other Embodiments

The above description is intended to allow the present invention to be readily understood but is not intended to limit the present invention. The present invention, of course, can be changed and modified without departing from the substance and purpose thereof and encompasses equivalents thereof.

For example, as other embodiments of the present invention, silencers 500, 510, 520, 530, and 540 shown in FIGS. 10 to 14 are conceivable and encompassed in the present invention.

Figure 10A:
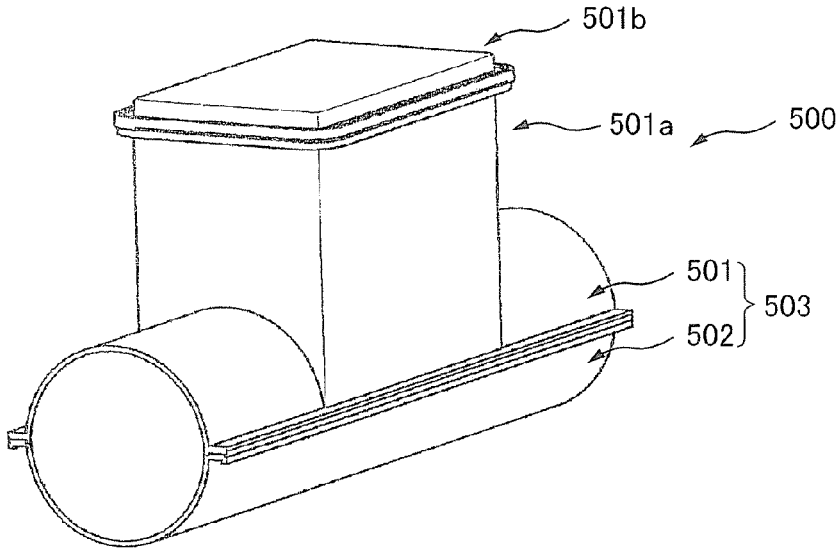
FIGS. 10A and 10B show another exemplary muffling structure (silencer 500) of a vent pipe.
Figure 10B:
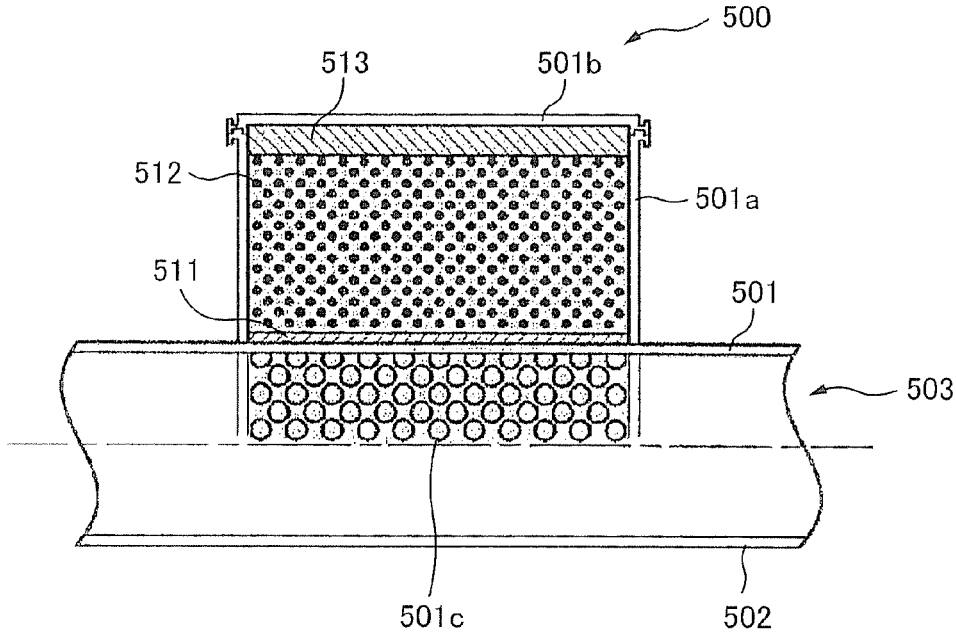

First, the silencer 500 shown in FIG. 10 is attached to a vent pipe 503, which includes an upper vent pipe 501 and a lower vent pipe 502 welded to each other. An accommodating portion 501*a* is integrated with an upper portion of the upper vent pipe 501, and a large number of vent holes 501*c* are formed in an upper surface portion of the upper vent pipe 501 that is covered with the accommodating portion 501*a*. The accommodating portion 501*a* contains activated charcoal 512, and a lid 501*b* is attached to an upper portion of the accommodating portion 501*a*. A ventilative member 511 is provided between the activated charcoal 512 and the upper surface portion of the upper vent pipe 501, and a cushion member 513 is provided between the activated charcoal 512 and the lid 501*b*.

Figure 11A:
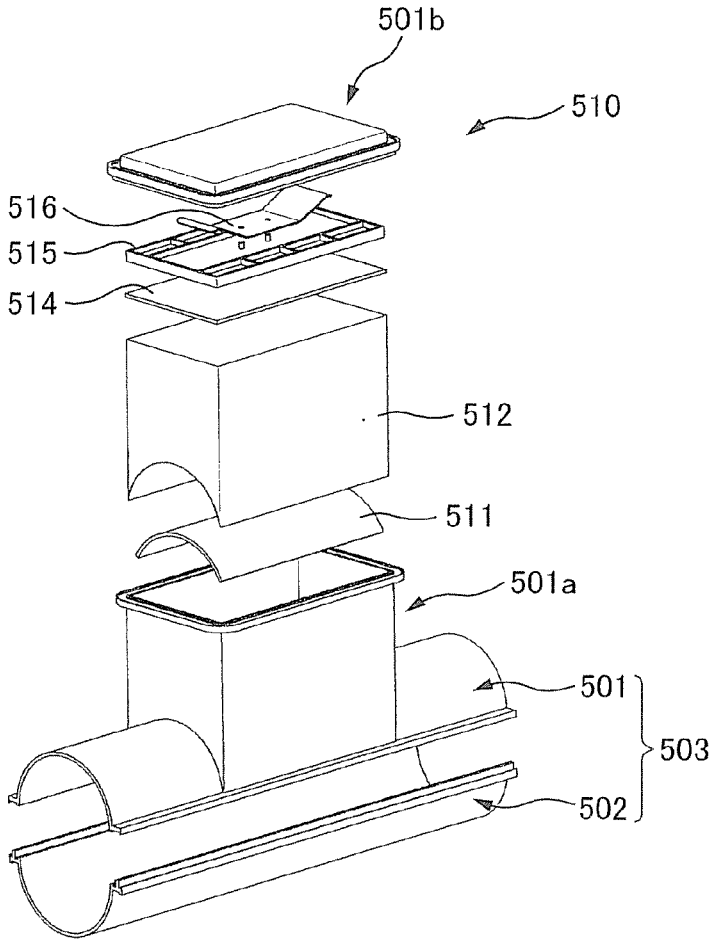
FIGS. 11A and 11B show another exemplary muffling structure (silencer 510) of a vent pipe.
Figure 11B:
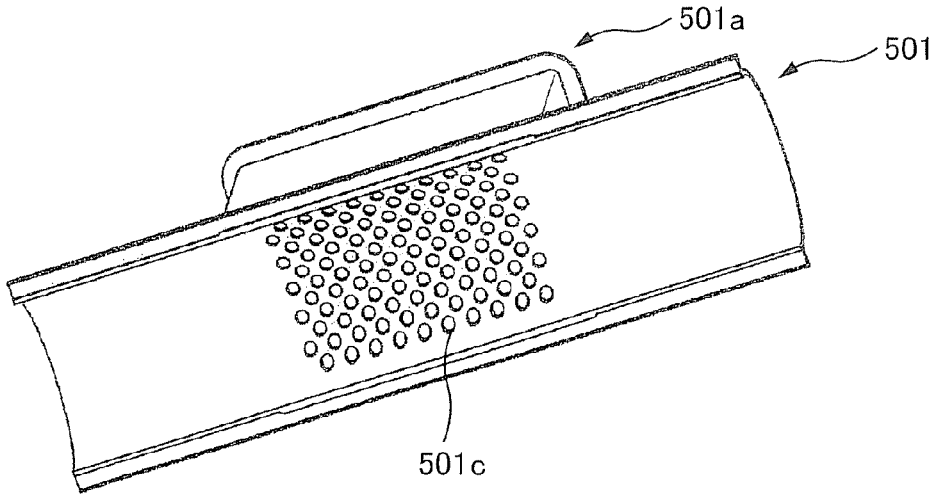
Figure 12:
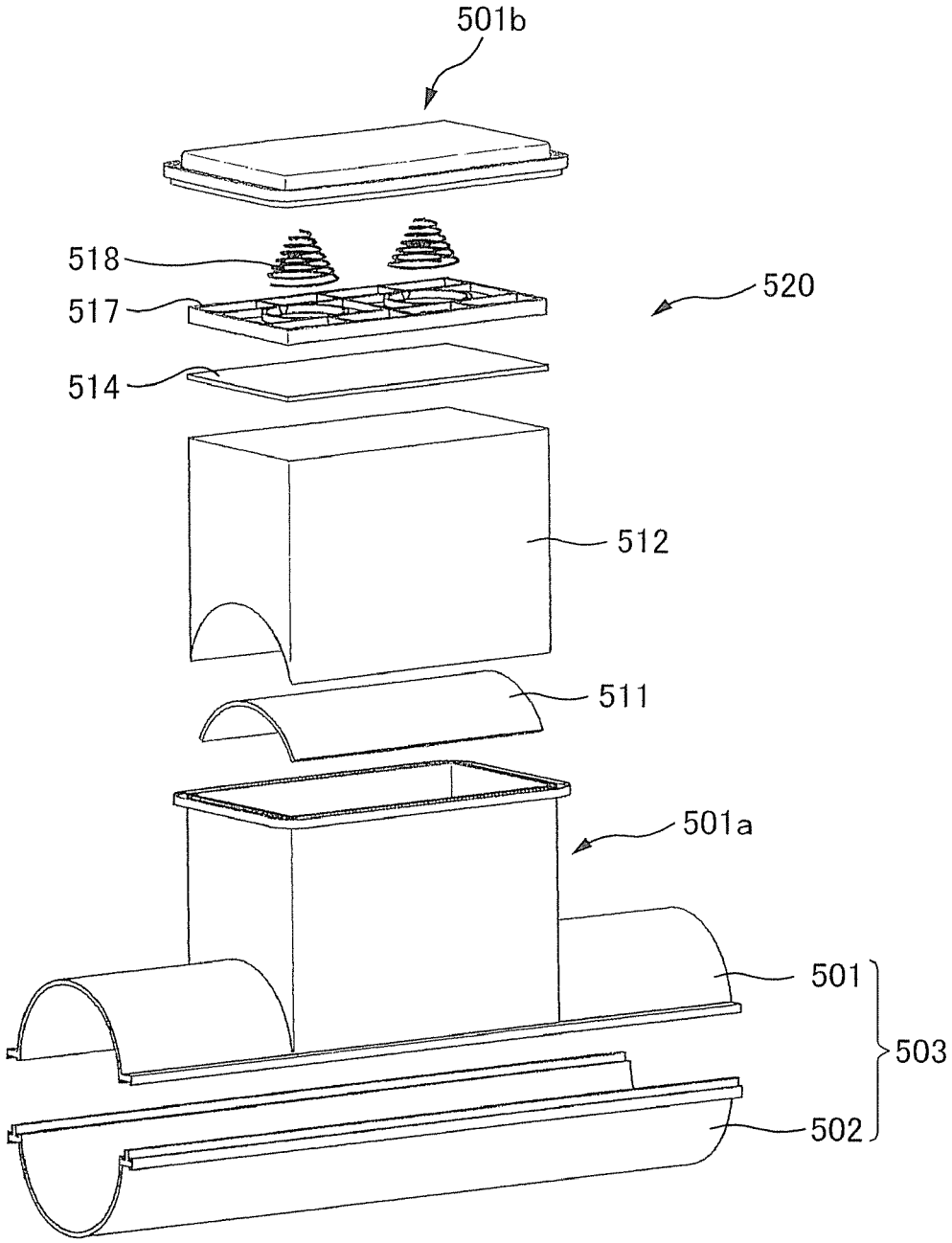
FIG. 12 shows another exemplary muffling structure (silencer 520) of a vent pipe.
Figure 13:
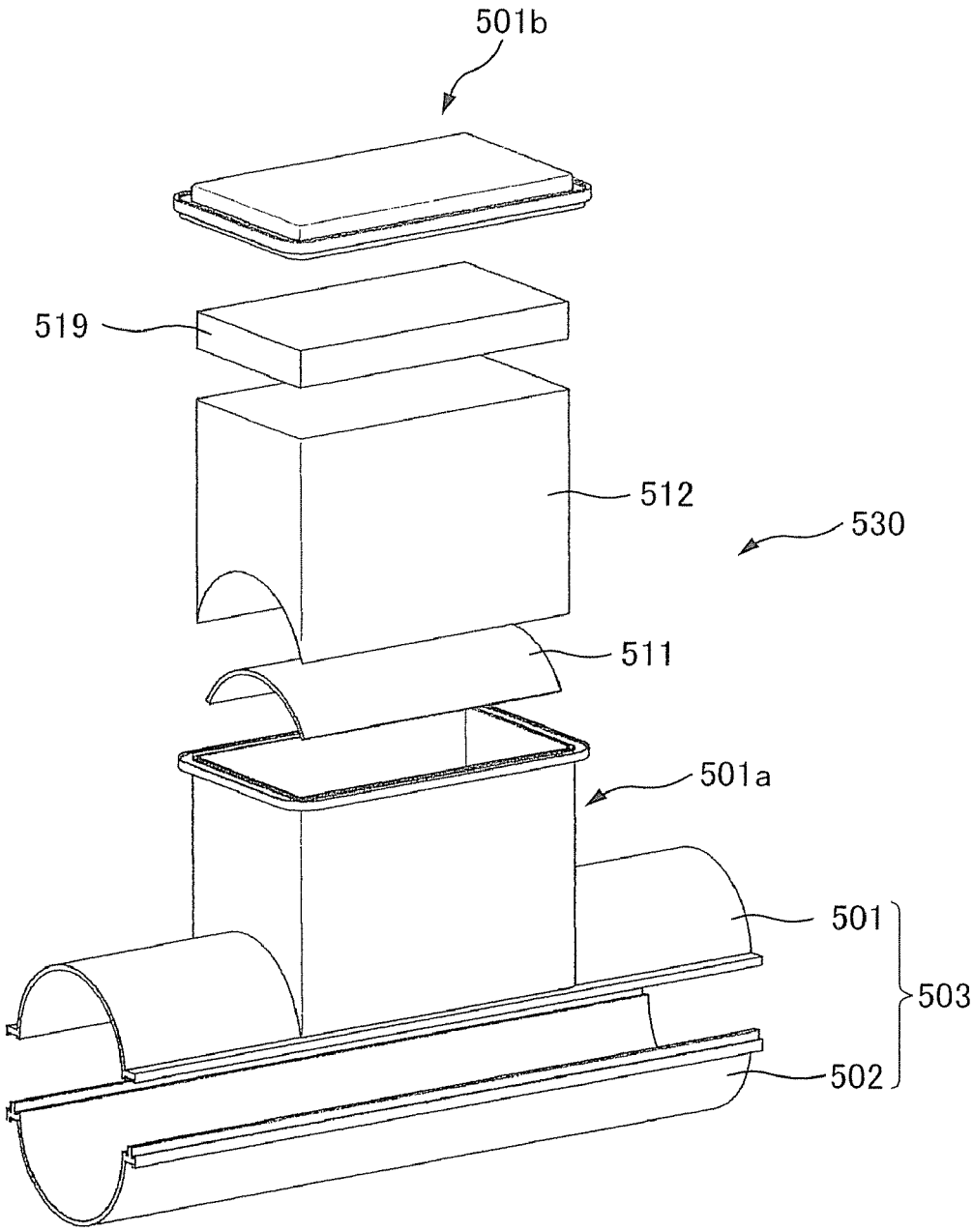
FIG. 13 shows another exemplary muffling structure (silencer 530) of a vent pipe.

Each of the silencer 510 shown in FIG. 11, the silencer 520 shown in FIG. 12, and the silencer 530 shown in FIG. 13 has a configuration substantially similar to that of the silencer 500 shown in FIG. 10.

The silencer 510, however, differs from the silencer 500 in that a nonwoven fabric 514, a compressing plate 515, and a plate spring 516 are provided between the activated charcoal 512 and the lid 501*b* in this order from the activated charcoal 512 toward the lid 501*b*.

The silencer 520 differs from the silencer 500 in that the nonwoven fabric 514, a compressing plate 517, and springs 518 are provided between the activated charcoal 512 and the lid 501*b* in this order from the activated charcoal 512 toward the lid 501*b*.

The silencer 530 differs from the silencer 500 in that a foam member (such as sponge) 519 is provided between the activated charcoal 512 and the lid 501*b*.

Figure 14A:
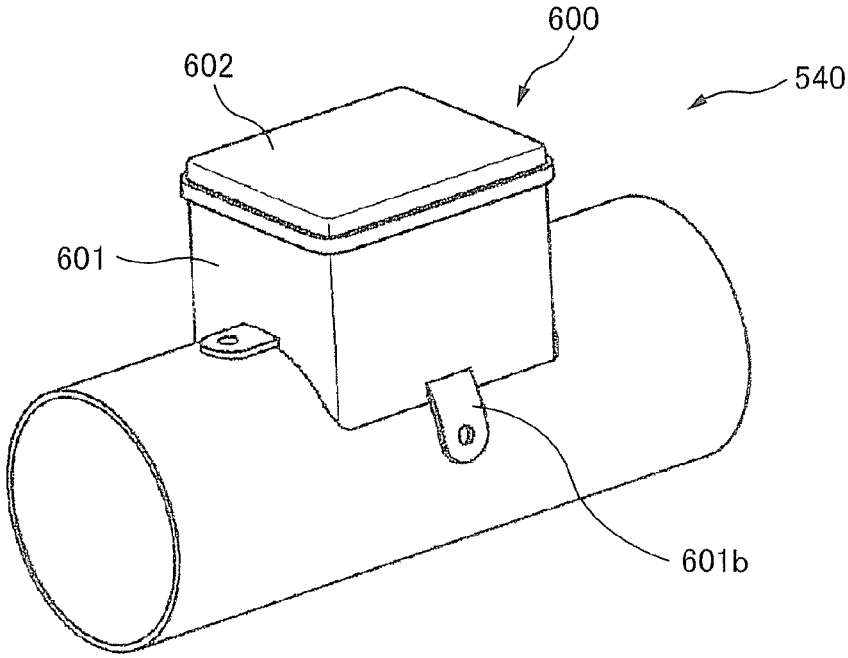
FIGS. 14A and 14B show another exemplary muffling structure (silencer 540) of a vent pipe.
Figure 14B:
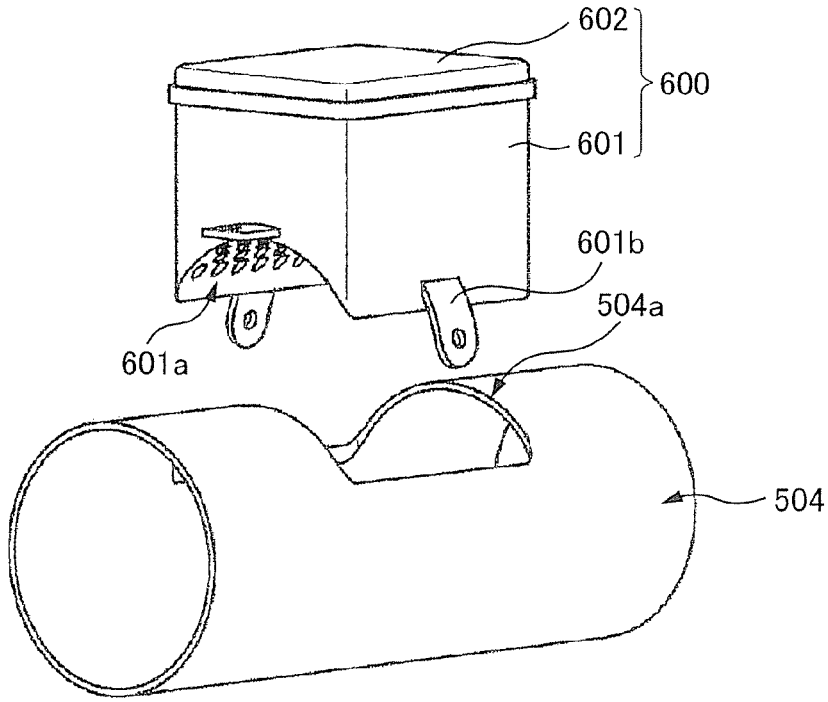

The silencer 540 shown in FIG. 14 is attached to a vent pipe 504 having an opening 504*a* formed in an upper portion thereof, and a container 600 is attached in such a manner as to cover the opening 504*a*. The container 600 is formed of an accommodating portion 601 and a lid 602 and contains activated charcoal (not shown) therein. A large number of vent holes 601*a* are formed in the bottom of the accommodating portion 601. An attachment portion 601*b* is provided on each side portion of the accommodating portion 601, and the attachment portions 601*b* are fixed to the wall of the vent pipe 504.

Each of the silencers (that is, the silencers 500, 510, 520, 530, and 540 shown in FIGS. 10 to 14) provides the same advantageous effect as that of the silencer of any of the embodiments of the present invention (silencer 310, for example), and specifically, can muffle sound in a wide frequency range and prevent vent resistance in a vent pipe or a case from deterioration.

Remarks

The present inventor has investigated an optimum shape of the silencer as indicated in the following items (1) to (7):

(1) Type of Activated Charcoal

Activated charcoal to be used is believed to be more excellent in muffling characteristics when the surface area thereof is larger. When activated charcoal is packed in a container efficiently (at a high density), activated charcoal having a smaller particle diameter is more advantageous. However, powdery activated charcoal having a very small diameter may clog the ventilative sheet and disperse into the atmosphere at the time of packing. It is therefore necessary to control the particle diameter distribution when the powdery activated charcoal is used. Further, since vibration causes activated charcoal to rub against each other into powder, hardness is also an important factor to prevent deterioration of the activated charcoal during use. It is therefore desirable to use activated charcoal controlled under the following conditions: the diameter (initial) equivalent to those of activated charcoal particles obtained under the JIS K1474 test method that pass through a sieve whose aperture size ranges from 0.5 mm to 4.5 mm defined by JIS Z8801, and the hardness being 95% or greater defined by JIS K1474.

(2) Communication Holes in Peripheral Wall of Duct

The area in which communication holes are formed affects the muffling effect, and providing communication holes in a largest possible area in the longitudinal direction of the duct (enlarging the silencer accordingly) enhances the muffling effect. Providing communication holes across the entire length of the duct is, however, not realistic. In consideration of a realistic amount of activated charcoal and a realistic shape of the silencer, communication holes (and a silencer) may be provided over one-sixth the entire length of the duct in a central portion in the longitudinal direction of the duct. In air-column resonance in a duct, since the primary resonance frequency range most affects the overall muffling effect, a central portion of the duct, where the level of the primary resonance can be greatly reduced and decrease in sound pressure at C2 can be minimized, is an optimum position. It is noted that the diameter of communication holes does not affect the muffling characteristics. Further, the muffling effect does not greatly vary when communication holes whose size is at least 10% of the projected area of the silencer are evenly distributed.

(3) Adequate Amount of Activated Charcoal

Consider changing the height of a silencer containing activated charcoal (vertical dimension from communication holes). The muffling effect reaches a plateau when the height is approximately 80 mm irrespective of the diameter of the duct. Increasing the height from 80 mm will not enhance the muffling effect. It is therefore effective to limit the height of the silencer to 80 mm at maximum. Further, consider changing the length of a silencer containing activated charcoal (in the longitudinal direction of the duct). It is most preferable to provide communication holes over approximately one-sixth the entire length of the duct in a central portion of the duct, as having been concluded in the section of communication holes in the peripheral wall of a duct. Further, when the area where communication holes are formed is fixed and only the length of the silencer is changed, the muffling effect is hardly affected. The silencer therefore only needs to be long enough to ensure the area in which the communication holes are formed. Moreover, the width of a silencer containing activated charcoal only needs to be equal to the inner diameter of the duct. In consideration of the factors described above, the amount of activated charcoal that is not only effective in muffling sound but also practical can be determined by the following equation: the length (the entire length of the duct/6)×the width (the inner diameter of the duct)×the height (80 mm), which are the inner dimensions of the silencer,=an optimum amount of activated charcoal (cc). When a duct is 56 mm in inner diameter and 600 mm in length, the optimum amount of activated charcoal is 100×56×80≈450 cc.

(4) Shape of Silencer

A silencer containing activated charcoal having a fixed volume shows a substantially same muffling effect irrespective of the shape of the silencer, such as a box-shape silencer and a cylindrical silencer.

(5) Position where Silencer is Disposed

When a silencer containing activated charcoal and having communication holes formed over a length of 100 mm is attached to a longitudinally central portion of a duct, the muffling effect is large in primary resonance, whereas the muffling effect is small in secondary resonance. When a silencer containing activated charcoal is attached to each end portion of a duct (in the position spaced apart from each end by one-fourth the entire length of the duct), the muffling effect is small in primary resonance, whereas the muffling effect is large in secondary resonance. It is most effective to dispose a silencer containing activated charcoal in a node position of the wavelength corresponding to a resonant frequency in question. When a plurality of silencers are attached to node positions of resonant frequencies of primary resonance, secondary resonance, and higher-order resonance, the muffling effect for each of the resonant frequency ranges is large but this approach is not realistic. Since it is most effective to address the primary resonant frequency of the duct when a high priority is placed on the overall muffling effect, a single silencer containing activated charcoal attached to a central portion of the duct provides a large muffling effect, which is the same conclusion as the conclusion on the area in which communication holes are formed.

(6) Comparison with Other Sound-Absorbing Materials

When the contents of the silencer is changed and comparison is made among activated charcoal, glass wool, and sponge (sound-absorbing sponge dedicated to automobile use), the activated charcoal provides the best muffling effect over all frequencies and at C2 and excels in muffling characteristics for each sound pressure level and for each order of the resonance components.

(7) Comparison with Porous Medium

When a silencer containing a porous medium is compared with a silencer containing activated charcoal, the sound at the intake tip is substantially the same, and the silencer containing activated charcoal is better in terms of transmitted sound and vent resistance. Further, a porous medium disadvantageously sucks warm air in an engine room, whereas a silencer containing activated charcoal will not suck warm air because there are no openings that communicate with the atmosphere other than the communication holes in the peripheral wall of the duct.

The invention claimed is:

1. A muffling structure of a vent pipe, characterized in that the vent pipe is a primary duct one end of which is connected with an air cleaner, the primary duct having a node position of primary resonance in the primary duct, wherein the node position is a central position of the primary duct, and the muffling structure comprises:

vent holes formed in a peripheral wall of the primary duct proximate the node position of primary resonance;

a cover so provided outside the peripheral wall as to cover the vent holes;

activated charcoal filled in the cover;

a ventilative member interposed between the activated charcoal and the peripheral wall; and any of a plate spring, springs, a foam member such as sponge, and a cushion member provided in a ceiling part inside the cover.

2. The muffling structure of a vent pipe according to claim 1, wherein the vent holes are formed in the peripheral wall except the bottom thereof.

3. A muffling structure of a case provided with a vent pipe for introduction purposes and a vent pipe for discharge purposes, the muffling structure comprising:

an inner pipe that is disposed in the case and communicates with the introduction vent pipe or the discharge vent pipe the inner pipe having a node position of primary resonance in a central portion of the inner pipe;

vent holes formed in a peripheral wall of the inner pipe proximate the node position of primary resonance;

a cover so provided outside the peripheral wall as to cover the vent holes;

activated charcoal filled in the cover;

a ventilative member interposed between the activated charcoal and the peripheral wall; and any of a plate spring, springs, a foam member such as sponge, and a cushion member provided in a ceiling part inside the cover.

4. The muffling structure of a case according to claim 3, wherein the vent holes are formed in the peripheral wall except the bottom thereof.

* * * * *